US010398198B2

(12) United States Patent
Orand et al.

(10) Patent No.: US 10,398,198 B2
(45) Date of Patent: Sep. 3, 2019

(54) SOLE STRUCTURE HAVING A DIVIDED CLEAT

(71) Applicant: NIKE, Inc., Beaverton, OR (US)

(72) Inventors: Austin Orand, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 133 days.

(21) Appl. No.: 15/464,794

(22) Filed: Mar. 21, 2017

(65) Prior Publication Data

US 2017/0273408 A1 Sep. 28, 2017

Related U.S. Application Data

(60) Provisional application No. 62/311,435, filed on Mar. 22, 2016.

(51) Int. Cl.

| | |
|---|---|
| ***A43C 15/16*** | (2006.01) |
| ***A43B 13/14*** | (2006.01) |
| ***A43B 13/12*** | (2006.01) |
| ***A43B 13/02*** | (2006.01) |
| ***A43B 13/04*** | (2006.01) |

(52) U.S. Cl.

CPC ..... *A43C 15/16* (2013.01); *A43B 13/026* (2013.01); *A43B 13/04* (2013.01); *A43B 13/122* (2013.01); *A43B 13/141* (2013.01); *A43C 15/162* (2013.01)

(58) Field of Classification Search

CPC ... A43B 13/141; A43B 13/181; A43B 13/122; A43B 13/026; A43B 13/04; A43C 15/16; A43C 15/162

See application file for complete search history.

(56) References Cited

U.S. PATENT DOCUMENTS

| | | | | |
|---|---|---|---|---|
| 3,502,275 A * | 3/1970 | Watson | E02D 1/02 | 100/233 |
| 4,283,865 A * | 8/1981 | Dassler | A43B 13/223 | 36/32 R |
| 4,658,514 A * | 4/1987 | Shin | A43B 5/06 | 36/30 R |
| 5,377,431 A * | 1/1995 | Walker | A43C 15/162 | 36/134 |
| 5,617,653 A * | 4/1997 | Walker | A43B 13/26 | 36/128 |

(Continued)

FOREIGN PATENT DOCUMENTS

WO WO 2008152502 A1 * 12/2008 ..... A43B 5/02

*Primary Examiner* — Jila M Mohandesi
(74) *Attorney, Agent, or Firm* — Quinn IP Law

(57) ABSTRACT

A sole plate for an article of footwear includes a foot-receiving surface and a ground-facing surface disposed opposite each other. A stiffness enhancing, ground-engaging cleat extends from the ground-facing surface of the sole plate. The ground-engaging cleat includes a first lug and a second lug. The first lug has a first foundation attached to the sole plate, and a first flex-limiting portion connected to the first foundation. The second lug has a second foundation attached to the sole plate, and a second flex-limiting portion connected to the second foundation. The first flex-limiting portion and the second flex-limiting portion contact each other in response to dorsiflexion of the sole plate equal to at least a predetermined flex angle, to increase a bending stiffness of the sole plate.

17 Claims, 9 Drawing Sheets

(56) References Cited

U.S. PATENT DOCUMENTS 6,151,803 A * 11/2000 Charles ..... A43B 7/32 36/107
6,675,505 B2 * 1/2004 Terashima ..... A43B 5/001 36/127
7,168,190 B1 * 1/2007 Gillespie ..... A43B 3/24 36/102
8,656,613 B2 * 2/2014 Stockbridge ..... A43B 13/00 36/102
9,468,264 B2 * 10/2016 Meythaler ..... A43B 5/02
2003/0033730 A1 * 2/2003 Burke ..... A43B 7/142 36/25 R
2003/0131502 A1 * 7/2003 Terashima ..... A43B 5/001 36/127
2005/0039350 A1 * 2/2005 Hung ..... A43B 7/32 36/107
2005/0268488 A1 * 12/2005 Hann ..... A43B 13/20 36/27
2009/0307926 A1 * 12/2009 O'Brien ..... A43B 7/28 36/29
2010/0154258 A1 * 6/2010 Scholz ..... A43B 13/141 36/30 R
2011/0016746 A1 * 1/2011 Callahan ..... A43B 3/0057 36/28
2011/0289801 A1 * 12/2011 Amos ..... A43B 13/141 36/134
2012/0174433 A1 * 7/2012 Mahoney ..... A43B 7/1425 36/28
2015/0143722 A1 * 5/2015 Faggin ..... A43B 3/108 36/25 R
2015/0237957 A1 * 8/2015 Cross ..... A43B 13/14 36/30 R
2017/0079374 A1 3/2017 Farris et al.
2017/0079375 A1 3/2017 Bunnell et al.
2017/0079376 A1 3/2017 Bunnell et al.
2017/0079378 A1 3/2017 Farris et al.

* cited by examiner

SOLE STRUCTURE HAVING A DIVIDED CLEAT

CROSS-REFERENCE TO RELATED APPLICATION

This application claims the benefit of priority to U.S. Provisional Application No. 62/311,435 filed on Mar. 22, 2016, which is hereby incorporated by reference in its entirety.

TECHNICAL FIELD

The present disclosure generally relates to a sole structure for an article of footwear.

BACKGROUND

Footwear typically includes a sole structure configured to be located under a wearer's foot to space the foot away from the ground. Sole structures in athletic footwear are configured to provide desired cushioning, motion control, and resiliency.

DETAILED DESCRIPTION

Figure 1:
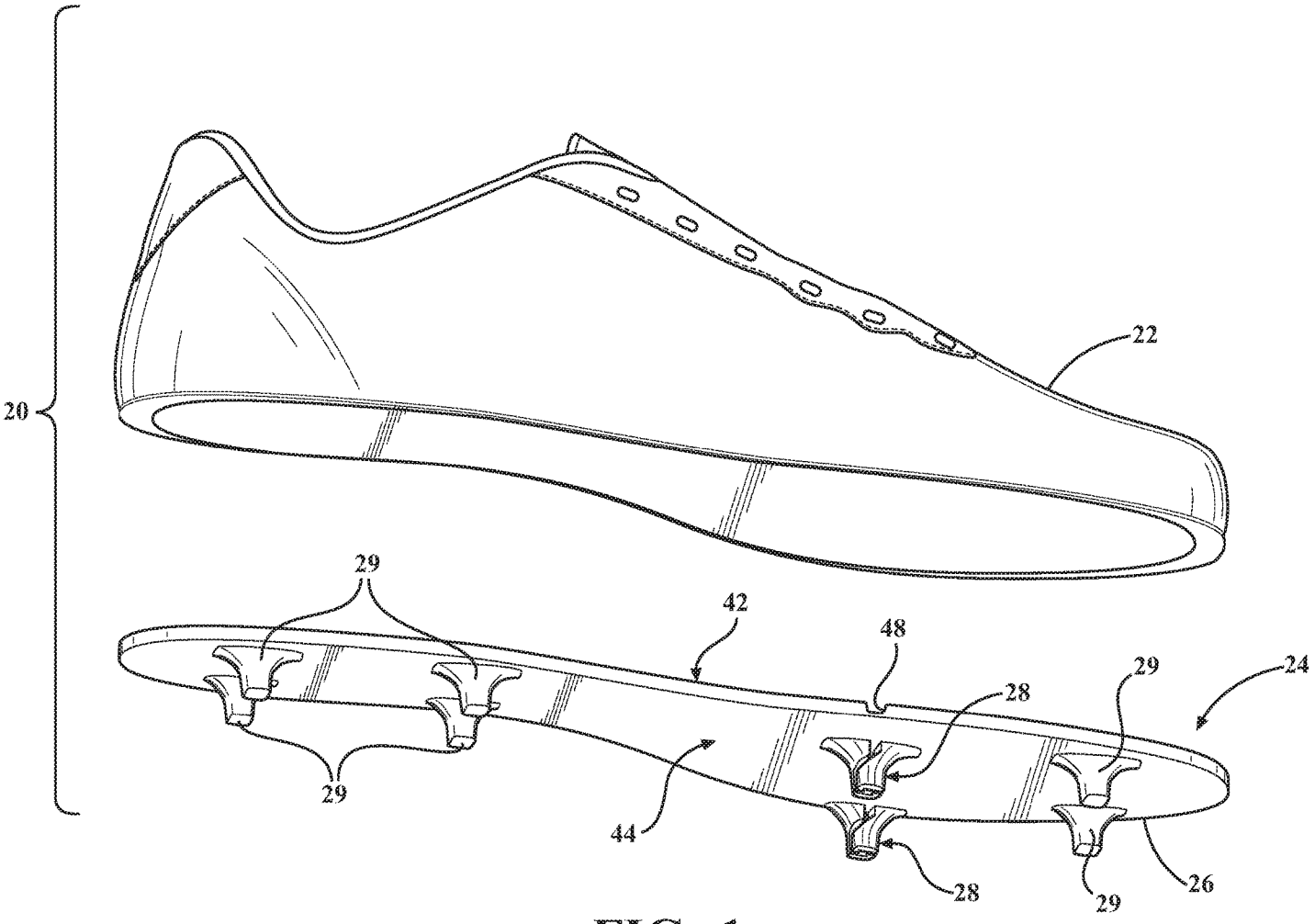
FIG. 1 is a schematic exploded perspective view of an article of footwear having an upper and a sole structure.

A sole structure for an article of footwear comprises a sole plate having a longitudinal axis. The sole plate includes a foot-receiving surface and a ground-facing surface disposed opposite of the foot-receiving surface. The sole structure includes a ground-engaging cleat that extends from the ground-facing surface of the sole plate. The ground-engaging cleat includes a first lug and a second lug. The first lug includes a first foundation attached to the sole plate, and a first flex-limiting portion connected to the first foundation. The second lug includes a second foundation attached to the sole plate, and a second flex-limiting portion connected to the second foundation. The first flex-limiting portion and the second flex-limiting portion contact each other in response to dorsiflexion of the sole plate that is equal to a predetermined flex angle. The first flex-limiting portion and the second flex-limiting portion contact each other and increase a bending stiffness of the sole plate at flex angles greater than the predetermined flex angle.

The sole plate includes a groove that is recessed into the foot-receiving surface of the sole plate. The groove extends along a groove axis that is transverse relative to the longitudinal axis of the sole plate. In an exemplary embodiment, the groove is linear, is aligned with the groove axis, and extends across an entire width of the sole plate.

In one embodiment, the first foundation is attached to the sole plate anterior to the groove axis, and the second foundation is attached to the sole plate posterior to the groove axis. Additionally, the first flex-limiting portion is disposed posterior to the groove axis, and the second flex-limiting portion is disposed anterior to the groove axis, with first flex-limiting portion and the second flex-limiting portion opposing each other across the groove axis from each other.

In an embodiment, the first flex-limiting portion extends from the first foundation, and presents a first contact surface that extends generally parallel to the groove axis. The second flex-limiting portion extends from the second foundation, and presents a second contact surface that extends generally parallel to the groove axis. The first contact surface and the second contact surface are generally parallel with each other when the sole plate is unflexed, i.e., when dorsiflexion of the sole plate along the longitudinal axis of the sole plate is approximately zero degrees, or the sole plate is in a relaxed, generally non-dorsiflexed condition.

In the embodiment, the first contact surface and the second contact surface contact each other when dorsiflexion of the sole plate is at least equal to the predetermined flex angle. Furthermore, the first contact surface and the second contact surface are each spaced from the ground-facing surface of the sole plate.

The features and advantages of the present teachings are readily apparent from the following detailed description of modes for carrying out the teachings when taken in connection with the accompanying Figures.

The terms "A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Referring to the Figures, wherein like numerals indicate like parts throughout the several views, an article of footwear is generally shown at 20 in FIG. 1. Referring to FIG. 1, the article of footwear 20 includes an upper 22 and a sole structure 24. The sole structure 24 may also be referred to as a sole assembly, especially when a corresponding sole plate 26 is assembled with other sole components in the sole structure 24, such as with other sole layers.

The upper 22 may include, for example, any conventional upper 22 suitable to support, receive and retain a foot of a wearer. The upper 22 includes a void configured to accommodate insertion of the wearer's foot, and to effectively secure the foot within the footwear 20 relative to an upper surface of the sole structure 24. The upper 22 typically includes one or more components suitable to further secure the user's foot proximate the sole structure 24, such as but not limited to a lace, a plurality of lace-receiving elements, and a tongue, as will be recognized by those skilled in the art. The upper 22 may be formed of one or more layers, including for example, one or more of a weather-resistant layer, a wear-resistant outer layer, a cushioning layer, and/or a lining layer. Although the above described configuration for the upper 22 provides an example of an upper 22 that may be used in connection with the embodiments of the sole structure 24 described herein, a variety of other conventional or nonconventional configurations for the upper 22 may also be utilized.

The sole structure 24 includes the sole plate 26 described herein, and has a nonlinear bending stiffness that increases with increasing flexion of a forefoot portion 32 in a longitudinal direction of the sole plate 26. As further described herein, the sole structure 24, and more specifically the sole plate 26, has at least one stiffness enhancing, ground-engaging cleat 28. The stiffness enhancing, ground-engaging cleat 28 provides a change in bending stiffness of the sole structure 24 when the sole structure 24 is flexed in the longitudinal direction at a predetermined flex angle 30. More particularly, the sole structure 24 has a bending stiffness that is a piecewise function with a change at the predetermined flex angle 30. The sole structure 24, and more specifically the sole plate 26, may further include one or more standard ground-engaging elements 29, i.e., cleats, which are not designed to alter the bending stiffness of the sole plate 26 at the predetermined flex angle.

The sole structure 24 of the article of footwear 20 extends between the foot and the ground to, for example, attenuate ground reaction forces to cushion the foot, provide traction, enhance stability, and influence the motion of the foot. When the sole structure 24 is coupled to the upper 22, the sole structure 24 and the upper 22 can flex in cooperation with each other.

The sole structure 24 may be a unitary structure with a single layer, or the sole structure 24 may include multiple layers. For example, a non-limiting exemplary multiple layer sole structure 24 may include an insole, an insole board, and an outsole for descriptive convenience herein. The insole may include a thin, comfort-enhancing member located adjacent to the foot. Optionally, a midsole may be provided. The outsole may include the ground-engaging cleat 28 described herein, and is usually fashioned form a durable, wear resistant material. Examples of such wear resistant materials may include, but are not limited to, nylon, thermoplastic polyurethane, carbon fiber, and others, as would be recognized by a person skilled in the art. In the exemplary embodiment shown in the Figures, the sole plate 26 is the outsole of the sole structure 24, and for clarity, is not shown with any other sole layers, e.g., the insole, the insole board, or the midsole.

Figure 2:
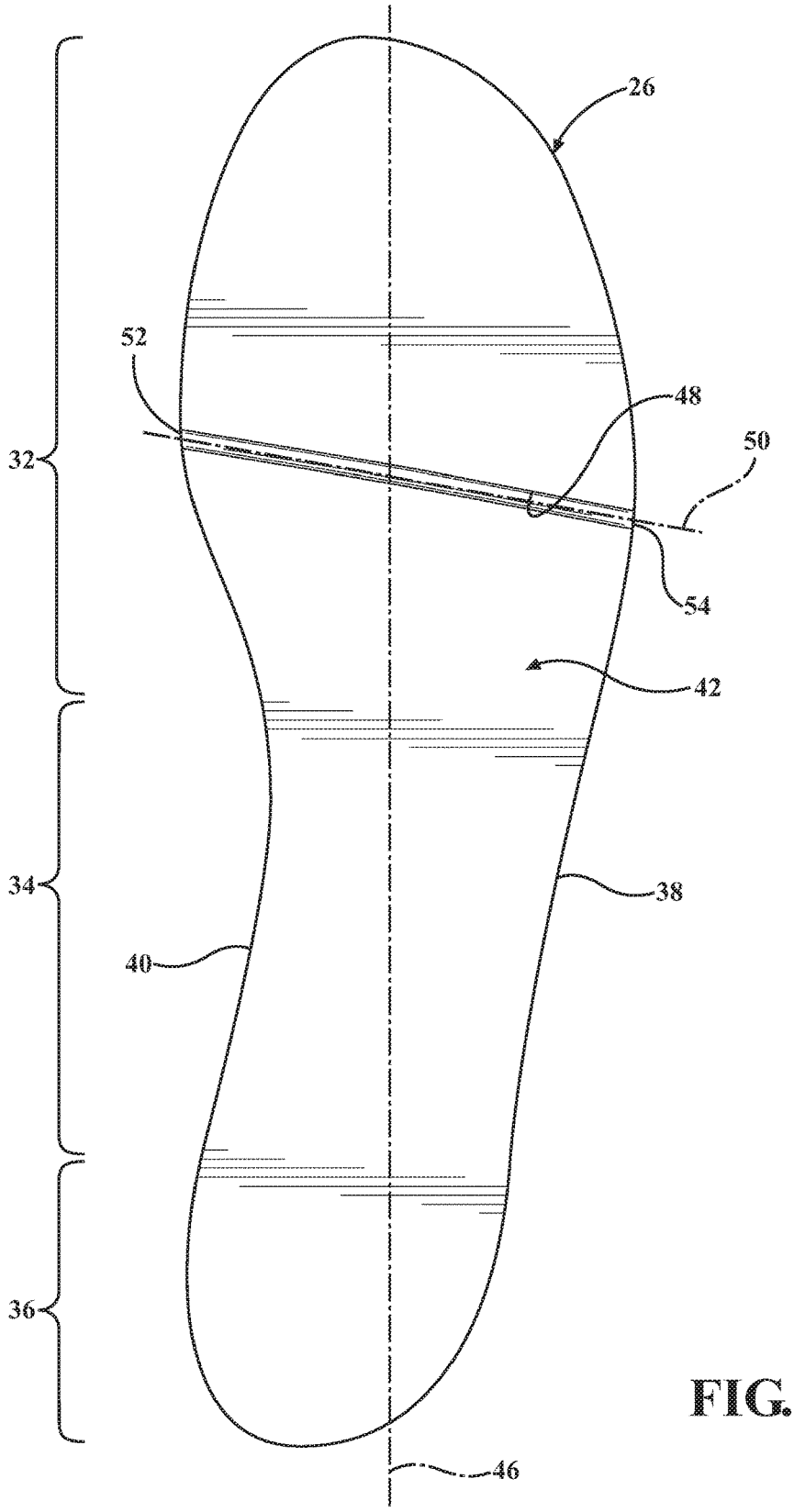
FIG. 2 is a schematic plan view of the sole structure viewed from a foot-receiving surface of the sole structure.
Figure 3:
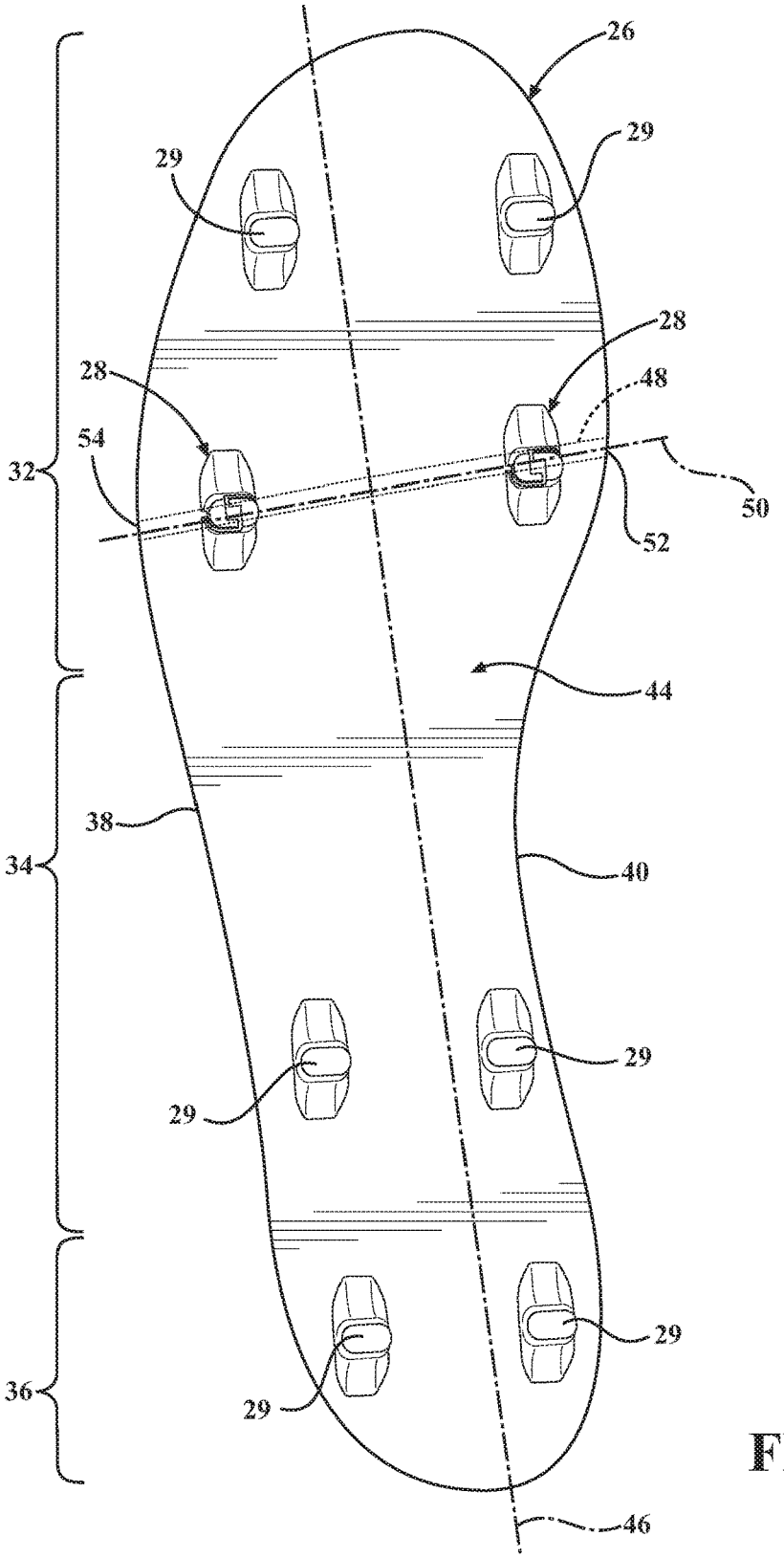
FIG. 3 is a schematic plan view of the sole structure viewed from a ground-facing surface of the sole structure.

Referring to FIGS. 2 and 3, the sole plate 26 may be a full-length, unitary sole plate 26 that has a forefoot portion 32, a midfoot portion 34, and a heel portion 36. Alternatively, the sole plate 26 may include a partial length sole plate 26 that includes only the forefoot portion 32 and the midfoot portion 34, and/or portions thereof, and which is attached to other components of the sole structure 24. The heel portion 36 generally includes portions of the sole plate 26 corresponding with rear portions of a human foot, including the calcaneus bone, when the human foot is supported on the sole structure 24 and is a size corresponding with the sole structure 24. The forefoot portion 32 generally includes portions of the sole plate 26 corresponding with the toes and the joints connecting the metatarsals with the phalanges of the human foot. The midfoot portion 34 generally includes portions of the sole plate 26 corresponding with an arch area of the human foot, including the navicular joint.

As shown in FIGS. 2 and 3, and as used herein, a lateral side of a component for an article of footwear 20, including a lateral edge 38 of the sole plate 26, is a side that corresponds with an outside area of the human foot (i.e., the side closer to the fifth toe of the wearer). The fifth toe is commonly referred to as the little toe. A medial side of a component for an article of footwear 20, including a medial edge 40 of the sole plate 26, is the side that corresponds with an inside area of the human foot (i.e., the side closer to the hallux of the foot of the wearer). The hallux is commonly referred to as the big toe.

The term "longitudinal," as used herein, refers to a direction extending along a length of the sole structure 24, i.e., extending from a forefoot portion 32 to a heel portion 36 of a sole structure 24. The term "transverse" as used herein, refers to a direction extending along a width of the sole structure 24, i.e., extending from a medial edge 40 of the sole plate 26 to a lateral edge 38 of the sole plate 26. The term "forward" is used to refer to the general direction from the heel portion 36 toward the forefoot portion 32, and the term "rearward" is used to refer to the opposite direction, i.e., the direction from the forefoot portion 32 toward the heel portion 36. The term "anterior" is used to refer to a front or forward component or portion of a component. The term "posterior" is used to refer to a rear or rearward component of portion of a component. The term "plate", such as the sole plate 26, refers to a generally horizontally-disposed member that is generally used to provide support structure and may or may not be used to provide cushioning. As used in this description and the accompanying claims, the phrase "bend stiffness" or "bending stiffness" generally means a resistance to flexion of the sole structure 24 exhibited by a material's composition, structure, assembly of two or more components or a combination thereof, according to the disclosed embodiments and their equivalents.

The sole plate 26 includes a foot-receiving surface 42, shown in FIG. 2, and a ground-facing surface 44, shown in FIG. 3. The foot-receiving surface 42 and the ground-facing surface 44 are disposed opposite of each other. A foot may be supported by the foot-receiving surface 42, with the foot disposed above the foot-receiving surface 42. The foot-receiving surface 42 may be referred to as an upper surface of the sole plate 26. The ground-facing surface 44 may be referred to as a lower surface of the sole plate 26.

The sole plate 26 is referred to as a plate, but is not necessarily flat and need not be a single component but instead can be multiple interconnected components. For example, both the foot-receiving surface 42 and the opposite ground-facing surface 44 may be pre-formed with some amount of curvature and variations in thickness when molded or otherwise formed in order to provide a shaped footbed and/or increased thickness for reinforcement in desired areas. For example, the sole plate 26 could have a curved or contoured geometry that may be similar to the lower contours of a foot. For example, the sole plate 26 may have a contoured periphery that slopes upward toward any overlaying layers, such as a component or the upper 22.

The sole plate 26 may be entirely of a single, uniform material, or may have different portions comprising different materials. For example, a first material of the forefoot portion 32 can be selected to achieve, in conjunction with other features and components of the sole structure 24 discussed herein, the desired bending stiffness in the forefoot portion 32, while a second material of the midfoot portion 34 and the heel portion 36 can be a different material that has little effect on the bending stiffness of the forefoot portion 32. By way of non-limiting example, the second portion can be over-molded onto or co-injection molded with the first portion. Example materials for the sole plate 26 include durable, wear resistant materials such as but not limited to nylon, thermoplastic polyurethane, or carbon fiber.

As best shown in FIGS. 2 and 3, the sole plate 26 includes a longitudinal axis 46, which extends along a longitudinal midline of the sole structure 24, between the heel portion 36 and the forefoot portion 32 of the sole structure 24.

Referring to FIG. 2, the sole plate 26 includes a groove 48 that is recessed into the foot-receiving surface 42 of the sole plate 26. The groove 48 extends along a groove axis 50, which is transverse relative to the longitudinal axis 46 of the sole plate 26. The groove 48 extends across an entire width of the sole plate 26. The groove 48 is generally straight, i.e., linear, and is aligned with the groove axis 50. The groove 48 has a medial end 52 and a lateral end 54, with the medial end 52 adjacent to the medial edge 40 of the sole plate 26, and the lateral end 54 adjacent to the lateral edge 38 of the sole plate 26. The lateral end 54 is slightly rearward or posterior of the medial end 52 so that the groove 48 falls under and generally follows the anatomy of the metatarsal phalangeal joints of the foot. The groove 48 extends generally transversely in the sole plate 26 from the medial edge 40 to the lateral edge 38.

Various materials may be used to manufacture the sole plate 26 discussed herein. For example, a thermoplastic elastomer, such as thermoplastic polyurethane (TPU), a glass composite, a nylon including glass-filled nylons, a spring steel, carbon fiber, ceramic or a foam or rubber material (such as but not limited to a foam or rubber with a Shore A Durometer hardness of about 50-70 (using ASTM D2240-05(2010) standard test method) or an Asker C hardness of 65-85 (using hardness test JIS K6767 (1976) may be used for the sole plate 26.

Figure 4:
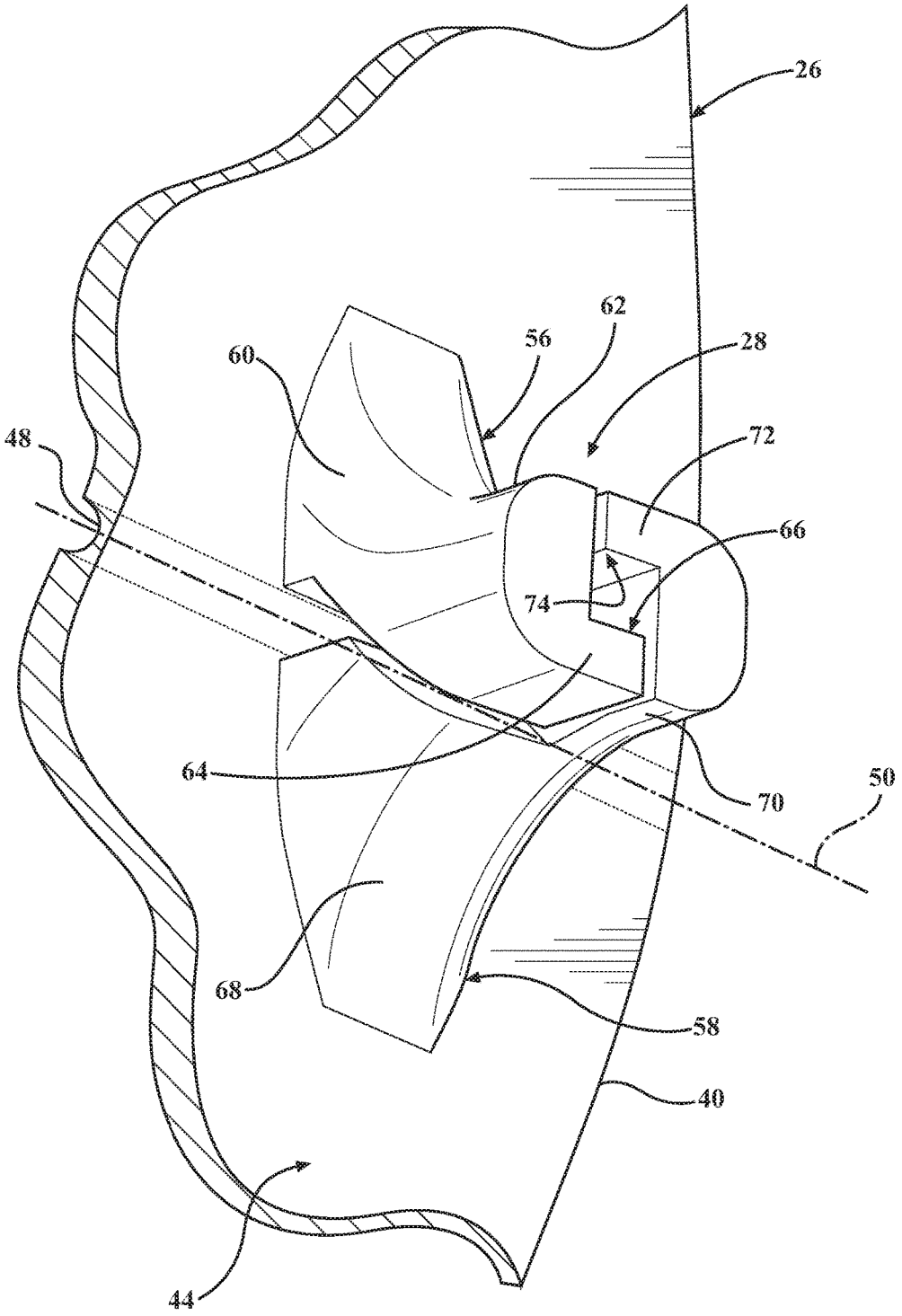
FIG. 4 is an enlarged, schematic fragmentary perspective view of a stiffness enhancing, ground-engaging cleat in an unflexed position, viewed from a first angle.
Figure 5:
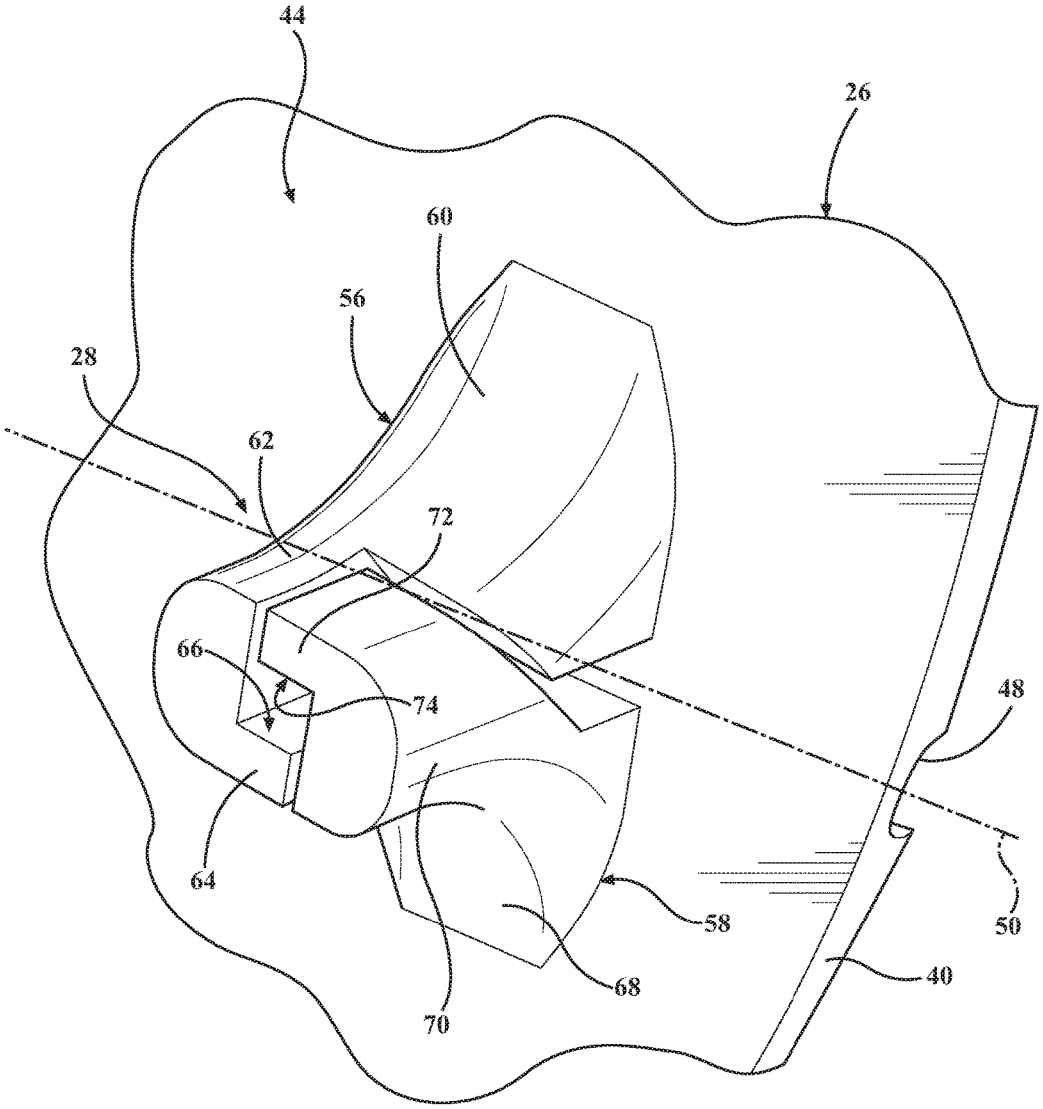
FIG. 5 is an enlarged, schematic fragmentary perspective view of the stiffness enhancing, ground-engaging cleat in the unflexed position, viewed from a second angle.

Referring to FIGS. 3-5, and as noted above, the sole plate 26 includes at least one stiffness enhancing, ground-engaging cleat 28, which extends from the ground-facing surface 44 of the sole plate 26. As noted above, the sole plate 26 may further include other, standard cleats or other ground-engaging elements 29. However, the detailed description herein is specifically directed toward the stiffness enhancing, ground-engaging cleat 28, described hereinafter as the ground-engaging cleat 28.

Generally, the overall longitudinal location of the groove 48 and the ground-engaging cleat 28 along the longitudinal axis 46 of the sole plate 26 is selected to be sufficient to accommodate a range of positions of the wearer's metatarsal phalangeal joints based on population averages for the particular size of footwear 20. The exemplary embodiment of the sole plate 26 includes two ground-engaging cleats 28, one disposed adjacent the lateral edge 38 of the sole plate 26, and another disposed adjacent the medial edge 40 of the sole plate 26. However, it should be appreciated that the sole plate 26 may include more than the two ground-engaging cleats 28 shown in the exemplary embodiment, or less than the two ground-engaging cleats 28 shown in the exemplary embodiment.

The ground-engaging cleat 28 includes a first lug 56 and a second lug 58. As best shown in FIG. 4, the first lug 56 includes a first foundation 60 attached to the sole plate 26, a first intermediate portion 62 attached to the first foundation 60, and a first flex-limiting portion 64 connected to the first intermediate portion 62. Accordingly, the first intermediate portion 62 interconnects the first foundation 60 and the first flex-limiting portion 64, such that the first flex-limiting portion 64 is attached to and supported by the first foundation 60. The first flex-limiting portion 64 extends from the first foundation 60, and presents a first contact surface 66 that extends generally parallel to the groove axis 50. The first intermediate portion 62 and the first flex-limiting portion 64 include a cross section, disposed on a plane that is parallel to both the longitudinal axis 46 and the groove axis 50, which is generally L-shaped.

As best shown in FIG. 5, The second lug 58 includes a second foundation 68 attached to the sole plate 26, a second intermediate portion 70 attached to the second foundation, and a second flex-limiting portion 72 connected to the second intermediate portion 70. Accordingly, the second intermediate portion 70 interconnects the second foundation 68 and the second flex-limiting portion 72, such that the second flex-limiting portion 72 is attached to and supported by the second foundation. The second flex-limiting portion 72 extends from the second foundation, and presents a second contact surface 74 that extends generally parallel to the groove axis 50. The second intermediate portion 70 and the second flex-limiting portion 72 include a cross section, disposed on a plane that is parallel to both the longitudinal axis 46 and the groove axis 50, which is generally L-shaped.

The first flex-limiting portion 64 and the second flex-limiting portion 72 oppose each other across the groove axis 50 from each other. More specifically, the first contact surface 66 of the first flex-limiting portion 64 and the second contact surface 74 of the second flex-limiting portion 72 oppose each other across the groove axis 50 from each other. The first contact surface 66 and the second contact surface 74 are generally parallel with each other when the sole plate 26 is in an unflexed state (i.e., when dorsiflexion of the sole plate 26 along the longitudinal axis 46 of the sole plate 26 is approximately zero degrees, or when the sole plate 26 is in a relaxed, generally non-dorsiflexed condition). The first contact surface 66 and the second contact surface 74 contact each other when dorsiflexion of the sole plate 26 along the longitudinal axis 46 increases to and equals the predetermined flex angle 30. The first contact surface 66 and the second contact surface 74 are each spaced from the ground-facing surface 44 of the sole plate 26 by a distance 76, and include a height 78 generally perpendicular to and extending away from the ground-facing surface 44 of the sole plate 26.

The first foundation 60 is attached to the sole plate 26 anterior to the groove 48 and the groove axis 50, and the second foundation 68 is attached to the sole plate 26 posterior to the groove 48 and the groove axis 50. The first flex-limiting portion 64 is disposed posterior to the groove axis 50, and the second flex-limiting portion 72 is disposed anterior to the groove axis 50. Accordingly, even though the first foundation 60 is anterior to the groove axis 50, the first contact surface 66 and the first flex-limiting portion 64 are positioned posterior to the groove axis 50. Similarly, even though the second foundation 68 is posterior to the groove axis 50, the second contact surface 74 and the second flex-limiting portion 72 are positioned anterior to the groove axis 50.

As noted above, and as shown in FIG. 8, the first flex-limiting portion 64 and the second flex-limiting portion 72 contact each other in response to dorsiflexion of the sole plate 26 being equal to the predetermined flex angle. Contact of the first flex-limiting portion 64 and the second flex-limiting portion 72 increases a bending stiffness of the sole plate 26 at flex angles that are greater than the predetermined flex angle, which operates to limit further dorsiflexion of the sole plate 26 beyond the predetermined flex angle.

Figure 7:
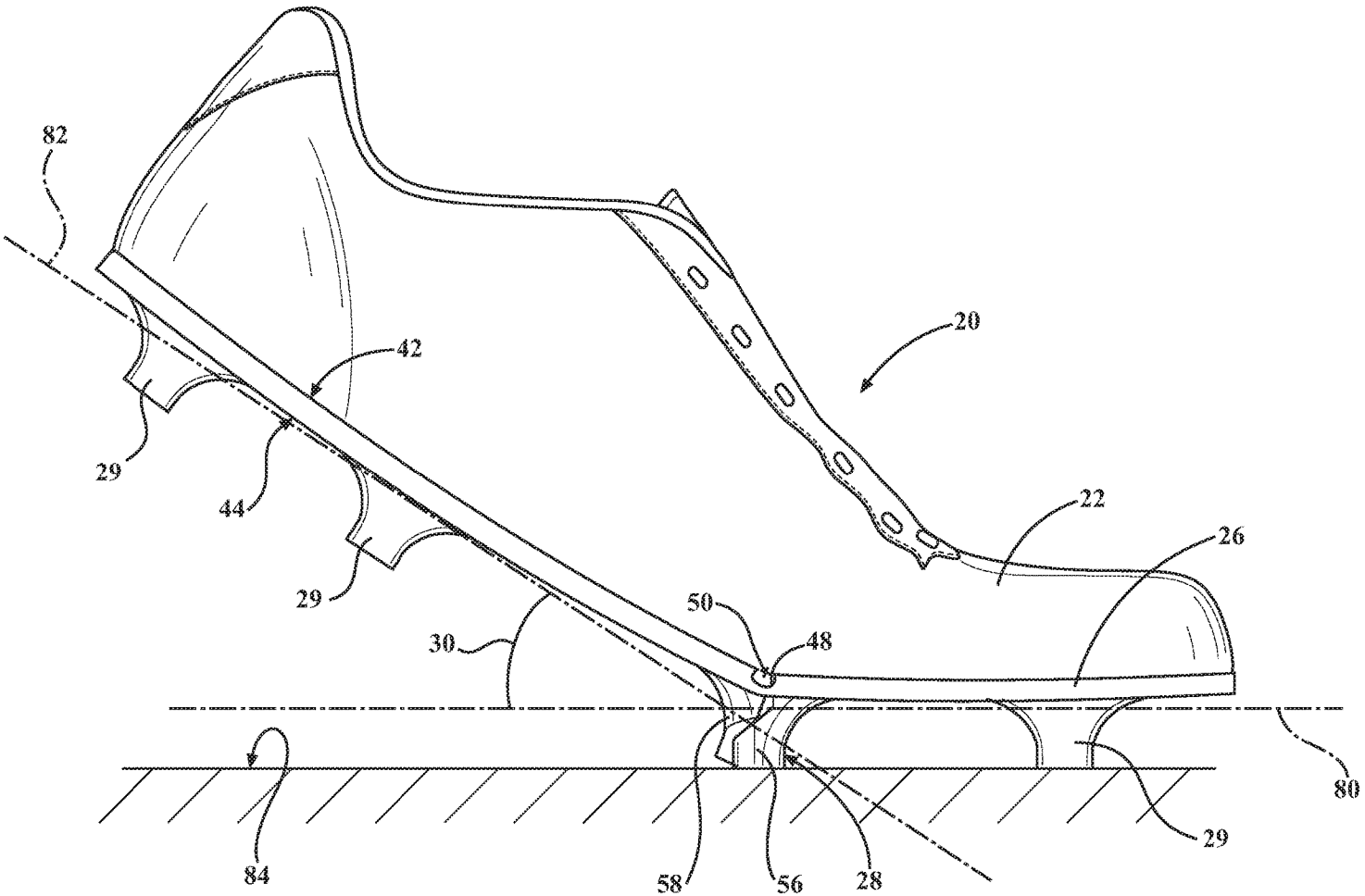
FIG. 7 is a schematic plan view of the side of the sole structure in a flexed position.

Referring to FIG. 7, the first predetermined flex angle 30 is defined as the angle formed at the intersection between a first axis 80 and a second axis 82. The first axis 80 generally extends along the longitudinal axis 46 of the sole plate 26 at the ground-facing surface 44 of the sole plate 26 anterior to the ground-engaging cleat 28. The longitudinal axis 46 of the sole plate 26 may also be referred to as a longitudinal midline of the sole plate 26. The second axis 82 generally extends along the longitudinal axis 46 of the sole plate 26 at the ground-facing surface 44 of the sole plate 26 posterior to the ground-engaging cleat 28. The sole plate 26 is configured so that the intersection of the first axis 80 and the second axis 82 is approximately centered both longitudinally and transversely below the groove 48, and below the metatarsal-phalangeal joints of a foot supported on the foot-receiving surface 42 of the sole plate 26. By way of non-limiting example, the predetermined flex angle 30 may be from about 30 degrees to about 65 degrees, with a typical value of about 55 degrees. In another exemplary embodiment, the predetermined flex angle 30 is found in the range of between about 15 degrees and about 30 degrees, with a typical value of about 25 degrees. In another example, the predetermined flex angle 30 is found in the range of between about 20 degrees and about 40 degrees, with a typical value of about 30 degrees.

Figure 6:
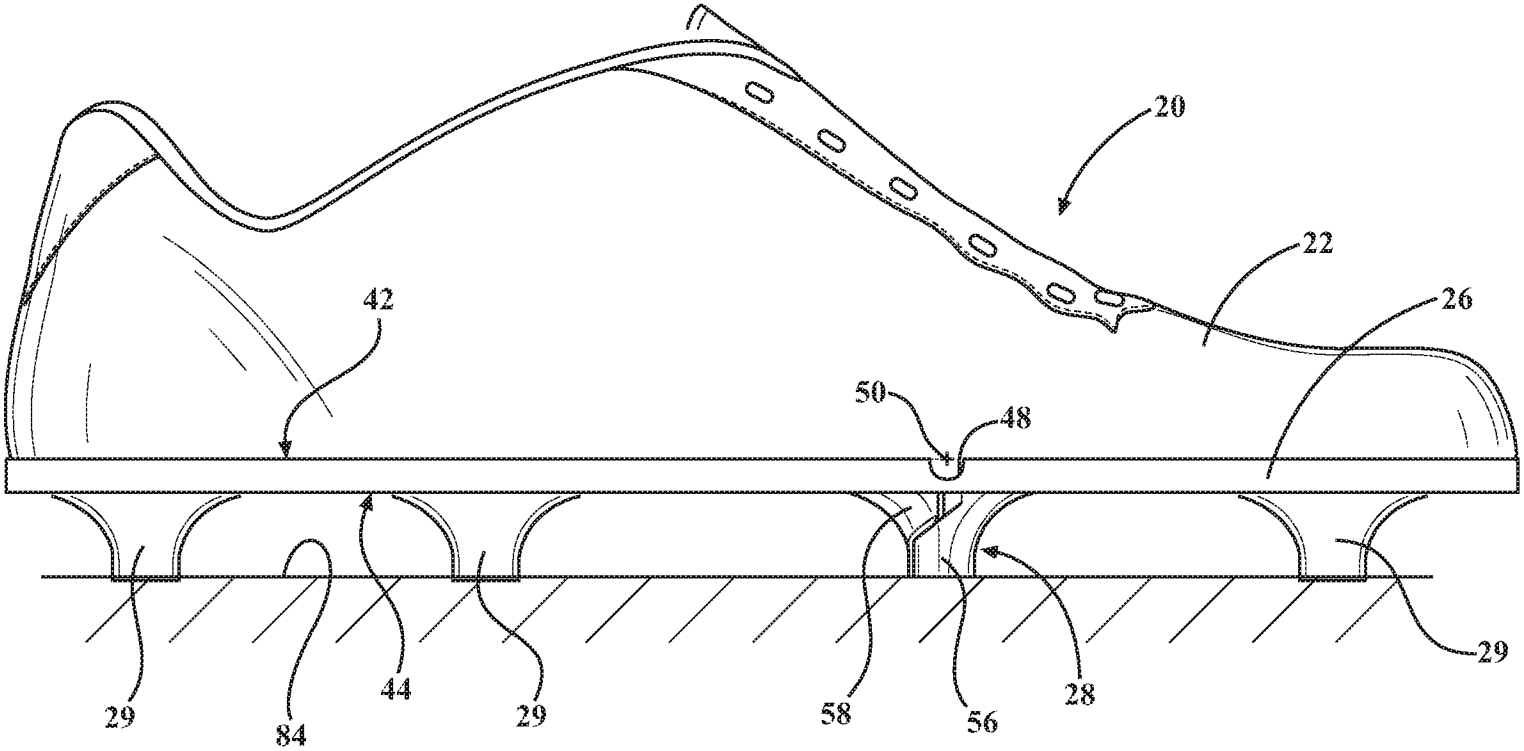
FIG. 6 is a schematic plan view of a side of the sole structure in the unflexed position.
Figure 9:
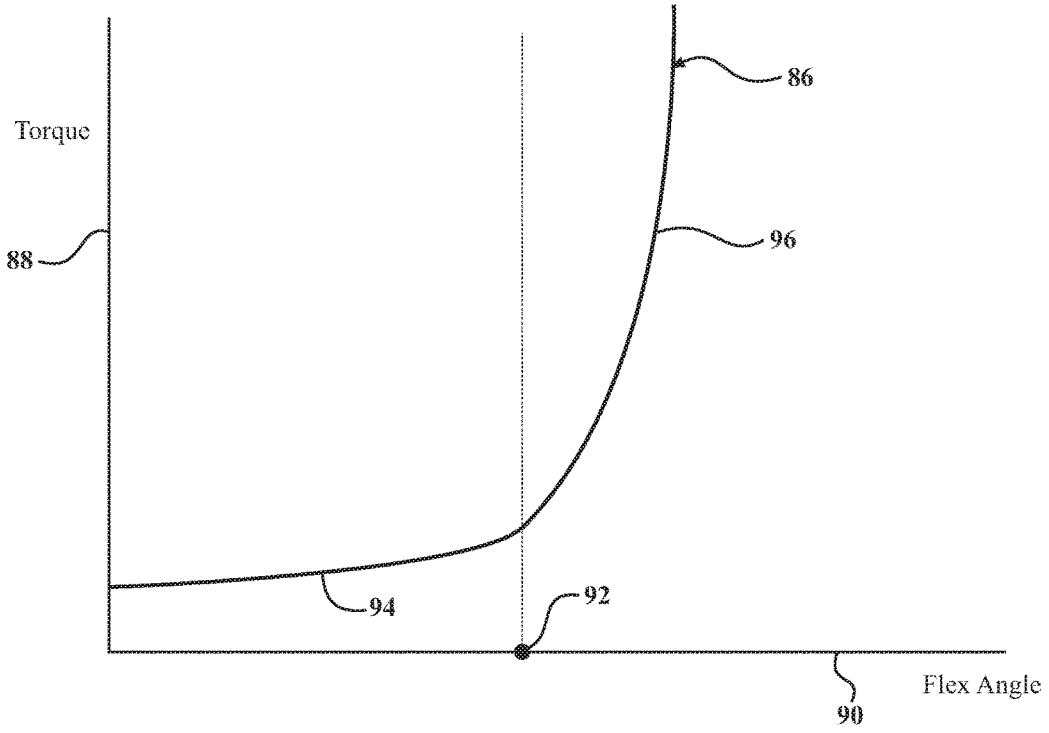
FIG. 9 is a plot of torque versus flexion angle for the sole structure.

FIG. 6 shows the sole plate 26 in the unflexed position, such that the first flex-limiting portion 64 and the second flex-limiting portion 72 do not contact each other, such as shown in FIGS. 4 and 5. Referring to FIG. 7, as a wearer's foot flexes by lifting the heel portion 36 away from a ground surface 84, while maintaining contact with the ground surface 84 at the forefoot portion 32, it places torque on the sole structure 24 and causes the sole plate 26 to flex at the forefoot portion 32, generally about the groove axis 50. Referring to FIG. 9, an example plot indicating the bending stiffness for the sole structure 24 is generally indicated by the slope of reference line 86. Torque (in Newton-meters) is shown on a vertical axis 88, and the flex angle (in degrees) is shown on a horizontal axis 90.

Figure 8:
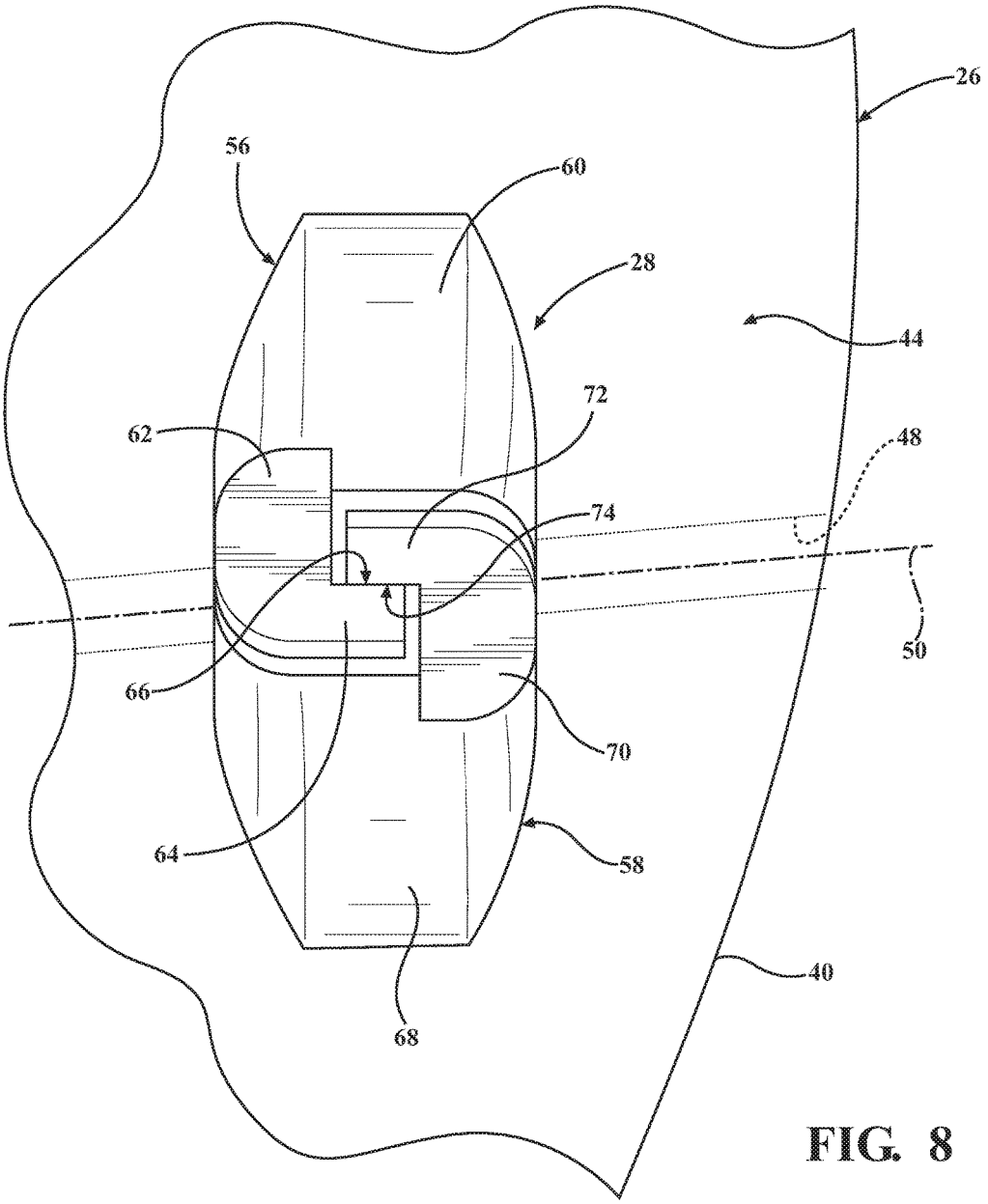
FIG. 8 is an enlarged, schematic fragmentary plan view of the stiffness enhancing, ground-engaging cleat in the flexed position.

As is understood by those skilled in the art, the torque results from a force applied at a distance from a bending axis located in the proximity of the metatarsal-phalangeal joints, as occurs when a wearer flexes the sole structure 24. The bending stiffness changes (increases) at the predetermined flex angle 30, shown in FIG. 9 by reference point 92 on the horizontal axis 90, and may be a piecewise function. In a first range of flexion, generally indicated by section 94 of the bending stiffness reference line 86 is a function of the bending stiffness of the sole plate 26 without compressive forces across the ground-engaging cleat 28, as the ground-engaging cleat 28 does not bear compressive forces when the first flex-limiting portion 64 and the second flex-limiting portion 72 do not contact each other. In a second range of flexion, generally indicated by section 96 of the bending stiffness reference line 86, is at least in part a function of the bending stiffness of the sole plate 26 and compressive loading of the sole plate 26 across the ground-engaging cleat 28, between the first flex-limiting portion 64 and the second flex-limiting portion 72, such as shown in FIG. 8, because the ground-engaging cleat 28 generates a compressive force between the first flex-limiting portion 64 and the second flex-limiting portion 72 when they are brought into contact with each other at the predetermined flex angle 30, which resists dorsiflexion of the sole plate 26.

Throughout the first portion of the flexion range 94, the bending stiffness will remain approximately the same as bending progresses through increasing angles of flexion. Because bending within the first portion of the flexion range 94 is primarily governed by inherent material properties of the materials of the sole plate 26, the graph of FIG. 9 showing torque on the plate versus angle of flexion (the slope of which is the bending stiffness reference line 86) in the first portion of the flexion range 94 will typically demonstrate a smoothly but relatively gradually inclining curve (referred to herein as a "linear" region with constant bending stiffness). At the boundary between the first flexion region 94 and the second flexion region 96, however, the compressive loading of the sole plate 26 across the ground-engaging cleat 28, i.e., between the first flex-limiting portion 64 and the second flex-limiting portion 72, engages additional material and mechanical properties that exert a notable increase in resistance to further dorsiflexion. Therefore, the second range of flexion 96 of the bending stiffness reference line 86 shows—beginning at an angle of flexion approximately corresponding to the predetermined flex angle 92—a departure from the gradually and smoothly inclining curve characteristic of the first range of flexion 94. This departure is referred to herein as a "non-linear" increase in bending stiffness, and would manifest as either or both of a stepwise increase in bending stiffness and/or a change in the rate of increase in the bending stiffness. The change in rate can be either abrupt, or it can manifest over a short range of increase in the bend angle of the sole plate 26. In either case, a mathematical function describing a bending stiffness in the second portion of the flexion range 96 will differ from a mathematical function describing bending stiffness in the first portion of the flexion range 94.

The bending stiffness in the first range of flexion 94 may be constant (thus the plot would have a linear slope) or substantially linear or may increase gradually (which would show a change in slope in the first range of flexion 94, such as shown in FIG. 9). The bending stiffness in the second range of flexion 96 may be linear or non-linear, but will depart from the bending stiffness of the first range of flexion 94 at the predetermined flex angle 92, either markedly or gradually (such as over a range of several degrees) at the first predetermined flex angle 92 due to the compressive loading of the sole plate 26 across the ground-engaging cleat 28, i.e., between the first flex-limiting portion 64 and the second flex-limiting portion 72.

As will be understood by those skilled in the art, during bending of the sole plate 26 as the foot is flexed, there is a neutral axis of the sole plate 26 above which the sole plate 26 is in compression, and below which the sole plate 26 is in tension. Bringing the first flex-limiting portion 64 and the second flex-limiting portion 72 into contact with each other places additional compressive forces on the sole plate 26 below the neutral axis, thus effectively shifting the neutral axis of the sole plate 26 downward (away from the foot-receiving surface 42) in comparison to a position of the neutral axis when the first flex-limiting portion 64 and the second flex-limiting portion 72 do not contact each other. Bringing the first flex-limiting portion 64 and the second flex-limiting portion 72 into contact with each other thereby increases the bending stiffness of the sole plate 26, which limits further dorsiflexion of the sole plate 26 along the longitudinal axis 46.

As noted above, dorsiflexion of the sole plate 26 is facilitated and generally centered about the groove 48 disposed in the foot receiving surface 42 of the sole plate 26, and the groove axis 50. As the sole plate 26 flexes, the ground-facing surface 44 of the sole plate 26 is placed in tension, and the first foundation 60 and the second foundation 68 are generally bent away from each other because the first foundation 60 is anterior to the groove axis 50, and the second foundation 68 is posterior to the groove axis 50. However, because the first intermediate portion 62 crosses over the groove 48 and the groove axis 50, the first intermediate portion 62 positions the first flex-limiting portion 64 and the first contact surface 66 posterior to the groove axis 50. Similarly, because the second intermediate portion 70 crosses over the groove 48 and the groove axis 50, the second intermediate portion 70 positions the second flex-limiting portion 72 and the second contact surface 74 anterior to the groove 48 and the groove axis 50. Accordingly, moving the first foundation 60 and the second foundation 68 away from each other, as occurs during dorsiflexion of the sole plate 26, moves the first flex-limiting portion 64 and the second flex-limiting portion 72 into compressive engagement with each other as the sole plate 26 flexes about the groove 48 and the groove axis 50, thereby generating a compressive force between the first flex-limiting portion 64 and the second flex-limiting portion 72, which resists further dorsiflexion of the sole plate 26.

The detailed description and the Figures are supportive and descriptive of the present teachings, but the scope of the present teachings is defined solely by the appended claims. While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear, the sole structure comprising:

a sole plate having a longitudinal axis, and including a foot-receiving surface and a ground-facing surface disposed opposite of the foot-receiving surface;

a ground-engaging cleat extending from the ground-facing surface of the sole plate in a direction away from the foot-receiving surface, the ground-engaging cleat including:

a first lug having a first foundation attached to the ground-facing surface of the sole plate, and a first flex-limiting portion connected to the first foundation with the first foundation between the ground-facing surface of the sole plate and the first flex-limiting portion; and a second lug having a second foundation attached to the ground-facing surface of the sole plate, and a second flex-limiting portion connected to the second foundation with the second foundation between the ground-facing surface of the sole plate and the second flex-limiting portion;

wherein the first flex-limiting portion and the second flex-limiting portion contact each other below the ground-facing surface of the sole plate in response to dorsiflexion of the sole plate along the longitudinal axis of the sole plate by an amount equal to a predetermined flex angle, and increase a bending stiffness of the sole plate at flex angles greater than the predetermined flex angle.

2. The sole structure set forth in claim 1, wherein the sole plate includes a groove recessed into the foot-receiving surface of the sole plate directly above the ground-engaging cleat, and extending along a groove axis that is transverse relative to the longitudinal axis of the sole plate; and wherein the first flex-limiting portion and the second flex-limiting portion contact each other directly under the groove.

3. The sole structure set forth in claim 2, wherein the groove extends across an entire width of the sole plate.

4. The sole structure set forth in claim 2, wherein the groove is linear, and is aligned with the groove axis.

5. The sole structure set forth in claim 2, wherein the first foundation is attached to the sole plate only anterior to the groove axis, and the second foundation is attached to the sole plate only posterior to the groove axis; and wherein the first flex-limiting portion is disposed only posterior to the groove axis, and the second flex-limiting portion is disposed only anterior to the groove axis.

6. The sole structure set forth in claim 5, wherein the first flex-limiting portion presents a first contact surface that extends generally parallel to the groove axis.

7. The sole structure set forth in claim 6, wherein the second flex-limiting portion presents a second contact surface that extends generally parallel to the groove axis.

8. The sole structure set forth in claim 7, wherein the first contact surface and the second contact surface are generally parallel with each other when the sole plate is in an unflexed position.

9. The sole structure set forth in claim 7, wherein the first contact surface and the second contact surface contact each other when dorsiflexion of the sole plate is equal to the predetermined flex angle.

10. The sole structure set forth in claim 2, wherein the first lug includes a first intermediate portion interconnecting the first foundation and the first flex-limiting portion and extending rearward over the groove axis from the first foundation to the first flex-limiting portion, and the second lug includes a second intermediate portion interconnecting the second foundation and the second flex-limiting portion and extending forward over the groove axis from the second foundation to the second flex-limiting portion.

11. The sole structure set forth in claim 2, wherein the first flex-limiting portion and the second flex-limiting portion oppose each other across the groove axis.

12. The sole structure of claim 1, wherein the sole plate includes a groove recessed into the foot-receiving surface of the sole plate and extending along a groove axis that is transverse relative to the longitudinal axis of the sole plate;

wherein the first lug includes a first intermediate portion interconnecting the first foundation and the first flex-limiting portion; and wherein the first intermediate portion and the first flex-limiting portion are L-shaped on a plane parallel to both the groove axis and the longitudinal axis.

13. The sole structure of claim 12, wherein the second lug includes a second intermediate portion interconnecting the second foundation and the second flex-limiting portion; and wherein the second intermediate portion and the second flex-limiting portion are L-shaped on the plane parallel to both the groove axis and the longitudinal axis.

14. A sole structure for an article of footwear, the sole structure comprising:

a sole plate having a longitudinal axis, and including a foot-receiving surface and a ground-facing surface disposed opposite of the foot-receiving surface; wherein the sole plate has a groove recessed into the foot-receiving surface of the sole plate;

a ground-engaging cleat extending from the ground-facing surface of the sole plate in a direction away from the foot-receiving surface, the ground-engaging cleat including:

a first lug having a first foundation connected to the sole plate entirely anterior to the groove and having a first flex-limiting portion connected to the first foundation via a first intermediate portion of the first lug, with the first foundation between the ground-facing surface of the sole plate and the first flex-limiting portion, and with the first flex-limiting portion disposed entirely posterior to the groove; and a second lug having a second foundation connected to the sole plate entirely posterior to the groove and having a second flex-limiting portion connected to the second foundation via a second intermediate portion of the second lug, with the second foundation between the ground-facing surface of the sole plate and the second flex-limiting portion, and with the second flex-limiting portion disposed entirely anterior to the groove;

wherein the first flex-limiting portion and the second flex-limiting portion oppose each other and contact each other in response to dorsiflexion of the sole plate along the longitudinal axis of the sole plate of at least a predetermined flex angle and increase a bending stiffness of the sole plate at flex angles greater than the predetermined flex angle.

15. The sole structure set forth in claim 14, wherein the groove extends along a groove axis transversely relative to the longitudinal axis of the sole plate.

16. The sole structure set forth in claim 15, wherein the groove is linear, aligned with the groove axis, and extends across an entire width of the sole plate.

17. The sole structure set forth in claim 14, wherein the groove extends along a groove axis transversely relative to the longitudinal axis of the sole plate; wherein the first flex-limiting portion presents a first contact surface that extends generally parallel to the groove axis, wherein the second flex-limiting portion presents a second contact surface that extends generally parallel to the groove axis, and wherein the first contact surface and the second contact surface are generally parallel with each other and spaced from each other when the sole plate is in a relaxed, generally non-dorsiflexed condition.

* * * * *